US008608095B2

(12) United States Patent
Naundorf et al.

(10) Patent No.: US 8,608,095 B2
(45) Date of Patent: Dec. 17, 2013

(54) METHOD FOR THE DISINTEGRATION OF LIGNOCELLULOSE TO FIBERS

(75) Inventors: Wolfgang Naundorf, Freiberg (DE); Werner Sitzmann, Hamburg (DE); Stephan Sternowsky, Trittau (DE)

(73) Assignee: Amandus Kahl GmbH & Co. KG, Reinbek (DE)

( * ) Notice: Subject to any disclaimer, the term of this patent is extended or adjusted under 35 U.S.C. 154(b) by 301 days.

(21) Appl. No.: 13/003,099

(22) PCT Filed: Jul. 10, 2009

(86) PCT No.: PCT/EP2009/005021

§ 371 (c)(1), (2), (4) Date: Jan. 7, 2011

(87) PCT Pub. No.: WO2010/003685

PCT Pub. Date: Jan. 14, 2010

(65) Prior Publication Data

US 2011/0108641 A1 May 12, 2011

(30) Foreign Application Priority Data

Jul. 10, 2008 (EP) ..... 08012508

(51) Int. Cl.
*B02C 1/00* (2006.01)

(52) U.S. Cl.
USPC ..... 241/21; 241/24.19; 241/24.29

(58) Field of Classification Search
USPC ..... 241/24.19, 21, 24.29, 29
See application file for complete search history.

(56) References Cited

U.S. PATENT DOCUMENTS

| | | | | |
|---|---|---|---|---|
| 4,308,033 | A | 12/1981 | Gunnerman | |
| 4,324,612 | A * | 4/1982 | Lindahl | 162/23 |
| 5,921,479 | A * | 7/1999 | Doenges et al. | 241/18 |
| 6,375,447 | B1 * | 4/2002 | Zitron et al. | 425/86 |

FOREIGN PATENT DOCUMENTS

| | | | |
|---|---|---|---|
| DE | 681 359 | | 9/1939 |
| DE | 746 417 | | 8/1944 |
| DE | 866 595 | | 2/1953 |
| DE | 1 074 390 | | 1/1960 |
| DE | 1 095 650 | | 12/1960 |
| DE | 1095650 | B * | 12/1960 |
| DE | 1 269 794 | | 6/1968 |
| DE | 1 183 352 | | 12/1968 |
| DE | 38 13 081 | | 11/1989 |
| DE | 199 55 844 | | 5/2000 |
| DE | 102 05 105 | | 8/2003 |
| DE | 10205105 | A1 * | 8/2003 |
| EP | 0 143 415 | | 3/1989 |
| WO | WO 02/07941 | | 1/2002 |

* cited by examiner

*Primary Examiner* — Dana Ross
*Assistant Examiner* — Chwen-Wei Su
(74) *Attorney, Agent, or Firm* — Alix, Yale & Ristas, LLP

(57) ABSTRACT

The method for disintegration of materials containing lignocellulose to fibers is characterized in that roller pressure is applied to the material containing lignocellulose in a flat die pellet mill by pinch rollers which can have an offset from the die of several millimeters, said pressure being applicable over a wide area, and the material being in a mixture with fiber-improving agents and moist on the surface, whereby the fiber improving agents, supported by the high moisture in the pore interiors, enter far into the interior of the fiber material and react spontaneously or with a delay, wherein finally the disintegrated and refined material is pressed through the bores of the flat die.

12 Claims, 1 Drawing Sheet

METHOD FOR THE DISINTEGRATION OF LIGNOCELLULOSE TO FIBERS

BACKGROUND

Disclosed is a method for the disintegration of lignocellulosic materials to fibers and a method for further processing these fibers.

Before lignocelluloses are processed into engineering and insulating materials, reinforcing or filler materials, cardboard or fuels they are typically comminuted into either shavings or fibers. The thin and usually arcuate fibers are increasingly winning out economically over the straight, stiff and strongly resilient shavings since they have better processing properties and the products produced therewith are of higher value.

The most widely used machines for defiberizing the lignocelluloses are grindstones, twin-screw extruders and also conical or disk refiners. Currently, it is the twin-disk refiners which dominate. In the twin-disk refiner, the defiberizing disintegration mainly takes place as a result of shearing stress exposure between the two parallel grinding disks which are profiled on their inside surfaces with ribs and of which one is mounted rigid and the other rotates at high speed. In the course of the disintegration process, the lignocelluloses stream radially as an aqueous flowable mass into the refiner and exit therefrom through the increasingly narrowing gap between the grinding disks. During the process, the lignocelluloses are gradually split open by shearing forces to form fibers of high to very high fineness.

Disadvantages of the defiberization machines mentioned include low throughput rates and/or high electrical energy requirements. The currently dominating refiner process moreover has the disadvantage that the defiberization of comparatively hard lignocelluloses, such as wood for example, only becomes possible once the raw material has been hydrothermally softened beforehand by a cooking process at high pressures of about 10 to 20 bar and temperatures of about 160 to 220° C. This is typically done with expensive equipment and significant thermal energy. Furthermore, the dewatering of the fibrous pulp generates large amounts of dirty wastewater.

The disintegration of lignocelluloses by means of refiners gives rise to fibers which are not very enhanced on the inside, since the defiberization process mainly involves the application of shearing stress. Therefore, the high porosity in the fibers is largely retained. In addition, admixed substances, such as binding and/or hydrophobicizing agents for example, become mainly dispersed on the surface of the fibers. The pore volume of the fibers contains gases, once the water has dried off. The pores in the fibers reduce the strength of the fibers and they compromise the compression characteristics of the fiber in the production of fiber base materials by pressing for example, since the gases enclosed in the pores increase the resistance to compression and reinforce the reexpansion after the pressure applied has been removed from the compressed material. The latter can even lead to the material being destroyed by expansion cracks.

The pore volume can also lead to product damage through the ingress of water and/or of microorganisms.

Within the context of the production of novel engineering materials based on lignocellulose, the disclosure provides a method for the disintegration of lignocelluloses having improved and also flexibly adjustable properties, which utilizes a low number of process stages and also low levels of thermal and electric energy, and which does not generate dirty wastewaters from a cooking process.

SUMMARY

The lignocellulosic materials in admixture with fiber improvers are subjected in a surface moist state in a flat die pellet press to a widely adjustable rolling pressure by pan grinder rollers, whereby—augmented by the high moisture in the pore interior—the fiber improvers penetrate far into the interior of the fiber material and react there spontaneously or after a delay, wherein the disintegrated and enhanced material is then subsequently forced through the drilled holes in a flat die.

"Fiber improvers" herein is to be understood as referring to substances which do not just further the spreading and comminution of the material, but are reaction capable substances which endow the fibers with novel, distinctly improved properties in respect of their further use as engineering materials. Their effect is modifying, altering, enhancing. The enhancement of the fibers takes place during the disintegration in the pellet press and particularly also thereafter during the drying and/or storage.

"Surface moist state" is to be understood as referring to a state in which the water content is approximately 5 to 15% higher than the saturation water content. This in turn indicates the moisture content of a raw material when its interior pore volume is fully filled with water and no additional surface moisture is present. All ligneous coals from different open cast mines or from various seams within an open cast mine, each wood or straw species and also identical woods of differing age have their own "saturation water content" dependent on the material structure and the pore structure. Therefore, this quantity is raw material specific. These saturation moisture contents are a minimum requirement for the formation of high value fibers in the pellet press. Comminution of partially or strongly pre-dried lignocelluloses using pellet presses always gives rise to a "shavinglike" comminution product in the main.

This is also the case with one prior art process (EP 0 143 415). This is because there the comminuted product is processed directly after comminution in a first pellet press into pellets in a further pellet press, and for this the material can have only a very low moisture content from the start, since otherwise the pressure required to produce at least semi-solid pellets cannot develop in the drilled holes in the die of the second pellet press. In addition, an excessive water content would, as a consequence of the heating in the second pellet press, lead to flash evaporation of the water on emergence from the pressing channels, which are at a high pressure, leading to unacceptable cracks in the pellets and to their ready collapse or more particularly their crumbling in the course of further handling. The purpose of this prior art process also differs fundamentally from the method of the present invention whereby neither a comminution of the coarsely pieced long fiber material is effectuated nor pellets are to be produced, but which has for the purpose to produce a fibrous engineering material having novel properties.

There is another prior art process (DE 199 55 844 A1) where, in contradistinction to the method of the present invention, pellets are to be produced from pressed biomass. To be able to produce these pellets, a wood moisture content of 11-14% is a mandatory requirement. In contrast thereto, the method described herein can operate at significantly higher moisture contents, namely the abovementioned surface moist state, i.e., a state where not just the pores are fully filled with water—which would correspond to a moisture content of up to 50% by weight—but in addition there is an excess moisture of 5 to 15% water present in the form of surface moisture. Nor does the prior art process utilize a fiber improving additive having the abovementioned properties, but maize (corn) starch to lower molding pressure, increase gliding performance and obtain builder properties. The fiber improvers used according to the disclosed method, by contrast, alter the properties of the fibers, since the fiber improvers penetrate into the fibers and thereby modify them. This penetration is achieved not just through the mechanical working, but also through the higher moisture content, so that wet chemical reactions can take place, which is not possible with the prior art pellets on account of the low moisture content. Furthermore, the production of pellets from wood has to utilize a very small press gap (separation of the pan grinder rollers from the die), namely up to 0.2 mm. The disclosed method, by contrast, allows larger separations of up to 2 mm or even up to 5 mm and hence lower rolling pressures.

The disintegration process utilizes flat die pellet presses wherein a high and specifically alterable preliminary pressure can be set on the pressing rolls. This can be accomplished for example by means of adjustable compressive springs or using a hydraulic system. The flat die pellet press is very useful for the defiberization process since the pressing force becomes concentrated in the narrowest gap between the flat die and the pressing roll on a very small lineal area, the so-called press seam. This makes it possible to set via the preliminary pressure, amplified using the hydraulic system for example, particularly high and also specifically variable specific molding pressures in the press seam. The high pressure applied to the material within the narrow press seam between a planar surface and the rounded surface of the pressing roll effectuates a harmonicalike spreading out of the lignocelluloses into individual fiber bundles, since the tensile strength in the lignocelluloses in a direction perpendicular to the fiber direction is significantly smaller than in the fiber direction and the pressed material can escape into the press spaces which widen on both sides of the press seam.

The feed material applied has to have the state of a surface moist mixture of solids, since the lignocelluloses soften as a result of the high water content, to enable the splitting process into fiber bundles. The surface moist state is also required because the lignocelluloses will only in that state have the necessary compressive plasticity which is required for a lateral squeezing of the material out of the press nip and hence makes the dissolution into individual fiber bundles possible in the first place. When the lignocelluloses are too dry, they have no means of escape but are completely pulled into the narrowest press nip, embrittled therein by high pressure densification and discharged as a solid sheet or in the form of shaving shaped material. On the other hand, the feed material must not be too moist, or otherwise it would assume under pressure the property of a water dispersed solid material and will retreat from any molding densification in the press nip between the flat die and the pan grinder rolls by flowing away prematurely. The feed material would then pass rapidly—without prior densification and without splitting into fiber bundles—away through the holes in the flat die.

The flat die pellet press is also very useful for the production of high value fibers from lignocelluloses because the feed material is not just densified using relatively high, but specifically adjustable specific molding pressures in the narrowest press nip, but the disintegration process is realized through a rolling pressure stress passing repeatedly over the material. This makes it possible to produce strongly densified low pore fibers without weakening through local overpressing of the solid material, since the densification process is realized through repeated over-rolling of the material through the press rolls in a gradual and hence gentle manner.

The multiple application of rolling pressure on the feed material at high but specifically adjustable specific molding pressures also provides for the admixed fiber improvers becoming gradually pressed into the interior pore volume of the increasingly thinner fiber bundles under the moist pasty conditions and a largely uninterrupted mixing to the fiber center is accomplished.

The flat die pellet press here is advantageous over the annular die pellet press in that the pan grinder rollers cannot unroll on the flat die without friction, since a relative movement between the pan grinder roller surface and the flat die press takes place close to the axis in a direction which is opposite to the direction of the relative movement in the edge region of the flat die press.

The type of fiber improvers is dependent on the field of use for the fibers to be produced and the properties to be fulfilled there. Useful fiber improvers include substances which during the disintegration process in the flat die pellet press and/or thereafter ultimately endow the fibers with the desired properties through physical and/or chemical reactions and also through partial filling of internal pore volume. The fiber improvers can be solutions, liquids and/or dispersed solids. The quality determining reactions take place between the resulting fiber and the fiber improvers, or some ingredients of both materials, and also to some extent in the fiber improvers themselves. The requisite intensity and the depth effect of the reactions in the fibers is achieved through the conjoint disintegration of lignocelluloses and fiber improvers in the flat die pellet press under the conditions of the sustained intensive rolling pressure stress and the aqueous medium required for the reactions.

Elevated product temperatures are not necessary for the practice of the disintegration process in the flat die pellet press; however, increasing product temperature typically facilitates the disintegration and impregnation process of the fibers and intensifies the reactions which take place.

Flat die pellet presses are also very useful for the disintegration of lignocelluloses to high value fibers having flexibly adjustable properties because the active disintegrating elements consist in part of a flat die with a large number of holes, the opening size, shape and spacing of which are selectable within wide limits. The large number of holes in the flat disk makes high rates of throughput possible. Furthermore, the hole openings avoid damaging the fibers through mechanical overstressing, since the fibers are discharged through the hole openings once they have reached the requisite fineness. The timely discharge is made possible by the high plasticity of the surface moist disintegration feed. The hole openings are engineered such that their admission resistance prevents excessively fast discharge of the product out of the disintegration space while at the same time avoiding any mechanical overstressing of the fibers through excessively slow discharge. Spacing between the holes, their format and the opening size of the holes and also the die thickness make it possible to adjust the intensity of the disintegration and reaction process such that the mandated fiber quality is achieved. The holes in the flat die allows disintegration without risking overstress at the high specific molding pressures in the press seams. Their opening size can vary with the desired fiber quality between about 2 to about 15 mm. Furthermore, the length and the geometry of the hole channels can be configured such that there is no occurrence of high displacement resistances which would lead to pellet formation. The disintegration product is discharged as a moistly interadhered crumbly mass.

The disintegration product is always chiefly discharged through the holes in the flat die. A further increase in the throughput rate of the disintegration machine is possible through a supplementary discharge of some of the disintegration product via a slanted edge weir.

Flat die pellet presses also provide intensive disintegration of lignocelluloses coupled with a high rate of throughput since the press rolls or pan grinder rollers can move at a high speed of about 2.1-2.6 m/sec along the central circular track and the presses are equipped with from 2 to 5 press rolls depending on the design size of the press. The largest presses can further have a large active die area of up to about 6000 $cm^2$.

The flat die pellet press is also very useful for the disintegration process because it allows for direct driving of the press rolls. This ensures that the feed material becomes disintegrated through the requisite over-rolling application of pressure. In the case of press rolls without direct drive, as in the case of annular die presses for example, there is a risk that the pan grinder roll will slide, without rotation of its own, like a sledge over the moist material without genuine defiberizing effect.

The high quality of the fibers and for the flexibly adjustable properties produced with the disclosed method are due mostly to the pronounced reduction in the pore volume in the fibers and also the modifying effect of the fiber improvers. The type of fiber improvers is dependent on the field of use of the fibers. The number of substances useful as fiber improvers is accordingly very large. Useful fiber improvers include for example lignite, black peat, water slurried cement, slaked lime, gypsum and/or ash paste, acids, salt solutions, pitches, asphalts, waxes, resins, glues and also a large number of starch, sugar and/or protein rich natural products.

The disintegrated material is typically discharged from the flat die pellet press as a more or less severely interadhered material having a high water content. The discharged material can be used directly for example as a fiber for the production of silages, as a predisintegrated feed or for producing fiber base materials by the wet hot press process. Other application scenarios utilize an aftertreatment through drying and/or through loosening comminution. Drying serves to set the final water content required for the further processing of the fiber. Furthermore, heating the material in the course of drying and also water withdrawal cause many important reactions between the fiber and the fiber improvers and/or in the fiber improver to be induced or amplified and completed. The loosening comminution dissolves interadhesions, nip bridges and positive bonds between the fibers. As the material treated according to the present invention is dried, it is observed that, advantageously, wood for example dries more quickly after the mechanical processing, since the water is no longer enclosed in cells.

The loosening postcomminution utilizes for example mechanical vortex mixers, disk mills, pin mills, impact plate mills or beater mills having one or two rotors. Drying is most suitably performed using for example convection dryers having mechanical loosening elements.

The disintegration method described provides high value fibers having flexibly adjustable properties, for example high binding capacity, high drying speed, improved digestion properties, high water resistance, selectively high resistance to biological degradation or acceleration of the microbiological transformation reactions, high mixing stability, improved compression properties through reduction in the densification resistances and through reduction in the elastic reexpansion following molding pressure removal, transformation of hydrophilic to hydrophobic substances, high structural strength, low resin requirements, increased soil fertility and so on. The fibers themselves can be used for example to produce high value fiber base materials even when the fineness of the fibers is lower than in the use of conventional refiner fibers.

The novel disintegration method for the production of fibers from lignocelluloses, in addition to the advantages already mentioned, is notable, in comparison with other defiberization processes, for low electric energy requirements of ≤50%, low thermal energy requirements, a low number of process stages and for the nongeneration of dirty wastewater through the elimination of pressure cooking prior to the disintegration process.

Further advantages of the method are the robustness of the flat die pellet press to hard contraries. Machine wear is low since subjecting the material to the action of rotating press rolls involves minimal wear due to friction. The contraries are either squashed or discharged by the press rolls since the press rolls escape upwardly in the event of overloading. The method is useful for the production of fibers from recent and/or fossil lignocelluloses in the form of lignite or fiber.

The admixing of the lignocelluloses, or of the lignocellulosic materials, with the suitable fiber improvers can take place in the form of solutions, liquids and/or dispersed solids in the mass ratio depending on the planned application for the fibers and with the addition of water in an amount that altogether a surface moist mixed material may be formed.

The enhancing effect of the fiber improvers can be realized through physical and/or chemical reactions between the newly formed fibers and the fiber improvers, or between ingredients of either feed material, through reactions in the fiber improvers and also through the partial filling of pore volumes in the fibers.

The flexible adjustment of the disintegration conditions and the type and proportion of the fiber improvers provide high value fibers having the particular properties required, for example improved drying and/or digestion and/or binding and/or compression properties and/or with high mixing stability and/or, as required, with high resistance to biodegradation or with improved properties for rapid microbiological transformation reactions.

It is advantageous to use a pellet press where the pan grinder rollers do not just unroll on the die but are equipped with their own drive. This can be accomplished via the drive of the rotary movement (vertical shaft) or via drive motors of their own.

In an advantageous embodiment, the disintegrated material discharges from the flat die pellet press not just through holes in the die but additionally via the edge of the flat die press, which is advantageously provided there with an edge weir.

The flat die chosen is a flat die having a hole geometry which depends on the fiber quality to be achieved in respect of format, opening size, hole spacing and hole channel length geometry and also having a die thickness which permits intensive rolling pressure densification without damage to the fibers, high rates of throughput and the discharge of product in a loose state without formation of firm pellets.

In preferred embodiments, the fiber improvers are advantageously selected singly or in combination from the following materials:

a. 5% to 60% by weight of lignite having deposit dependent saturation water contents of 50 to 60%;
b. 10% to 40% by weight of cement (dry) after moistening to form mortar;
c. 1% to 40% by weight of slaked lime (dry) after moistening to form mortar;

d. 5% to 40% by weight of gypsum (dry) after moistening to form mortar;
e. 5% to 50% by weight of power station filter ashes (dry) after wet disintegration grinding to form a mortar mass;
f. 5% to 60% by weight of lean quark or quark rich enhancement products;
g. 5% to 25% by weight of protein rich extraction grains from oilseeds (dry) after wet disintegration grinding to form a finely disperse mass and/or through cooking of the pasty mass;
h. 3% to 15% by weight of starch or starch rich raw materials (dry) after disintegration into pasty glues or after thin cooking;
i. 1% to 15% by weight of sugar or sugar rich raw materials after dissolution;
j. 1% to 15% by weight of natural or synthetic glues;
k. 0.5% to 10% by weight of paraffins and/or asphalts, pitches, waxes, resins after liquefaction thereof;
l. finely granular or liquid nutrient materials, mineral salts and/or vitamins of the type and amount required in the use scenario;
m. salt for producing fibers for silages;
n. 1% to 20% by weight of acids and/or salts having a preservative action;
o. fertilizers of the type and proportion needed by the field of use; and
p. clay and loam minerals in the proportions depending on the use scenario.

Advantageously, the moist and interadhered fibers discharged from the flat die pellet press are further processed through storage and/or drying and/or loosening comminution to form a fiber of waddinglike texture. The loosening comminution of the interadhered fiber to form a fiber having a waddinglike texture after a pre-drying to moisture contents of $w \leq 50\%$ utilizes mechanical vortex mixers, disk mills, pin mills, bladed disk mills, impact plate mills or beater mills having one or two rotors. The drying and loosening of the fiber can be carried out simultaneously with, for example, dryers equipped with mechanical loosening devices.

The material thus produced can be dried at lower energy requirements, since the initial moisture content is less than for the use of refiners. The fiber can then be pressed, particularly into pellets, strands, plaques or the like. The product thus produced can then be used in various ways depending on its composition. Possible uses include for example engineering and insulating materials, building materials, reinforcing or filler materials, cardboard, pore formers or fuels.

Depending on the intended use, pellet presses having smooth or profiled (grooved) surfaces on the pan grinder rollers and/or dies can be used.

The disclosed method makes it possible to achieve/set the following properties:

fiber fineness and length can be varied.

the intensity of the densification of the inner pore volume.

stronger or reduced hygroscopicity (water uptake capacity) of the fibers.

resistance of the fibers to degradation by microorganisms.

adhesion properties of the fiber surfaces with regard to glues or other binding materials can be set as desired.

particularly good compression characteristics of the fibers, for example in the pressed densification into engineering materials (low resistance of the fibers in the course of the pressed densification and no re-expansion following the pressed densification).

high stability of mixtures (no separation in the case for example of fibers used as feed). Firm incorporation of, for example, vitamins, minerals, groats, flours, salts in the fibers.

acceleration of the silagemaking process (defiberization of the lignocelluloses on addition of salt and possibly other assistants).

distinct improvement in drying properties over shavings.

BRIEF DESCRIPTION OF THE DRAWINGS

The invention will now be elucidated by way of example with reference to the accompanying drawings, where.

DETAILED DESCRIPTION

Figure 1:
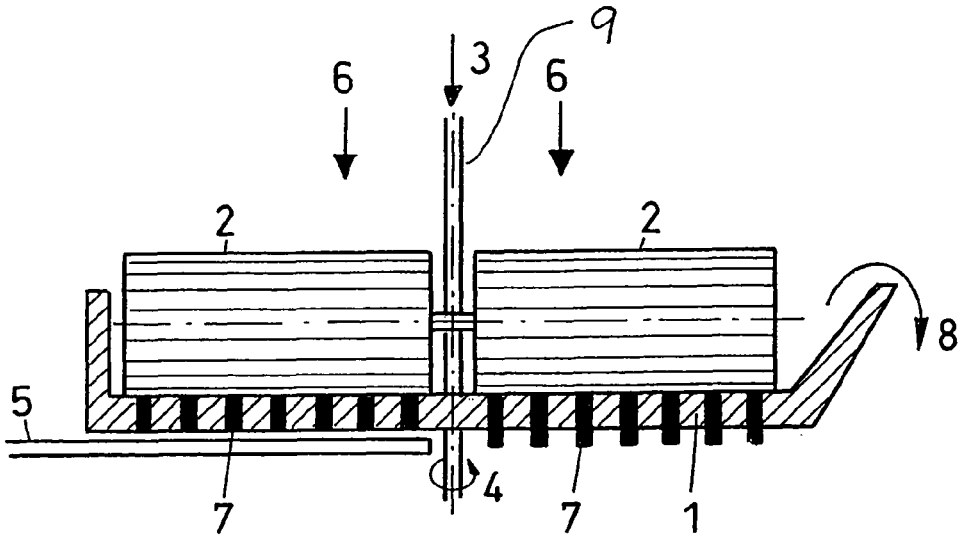
FIG. 1 shows an in-principle depiction of the pellet press used according to the present invention.

FIG. 1 shows the principle of a pellet press wherein a flat die 1 has pan grinder rollers 2 unrolling on it which have a pressing force applied to them in the direction of arrow 3. The pan grinder rollers 2 unroll on the die 1 by the turning of the vertical shaft 9 in the direction of arrow 4. Product 7 is applied in the direction of arrows 6, forced through drilled holes in the die 1, reemerges on the underside thereof, and is divided by a cutter 5. In contrast to the normal operation of a pellet press, some of the product can also exit at 8 via the edge of the die 1 over an edge weir.

Figure 2:
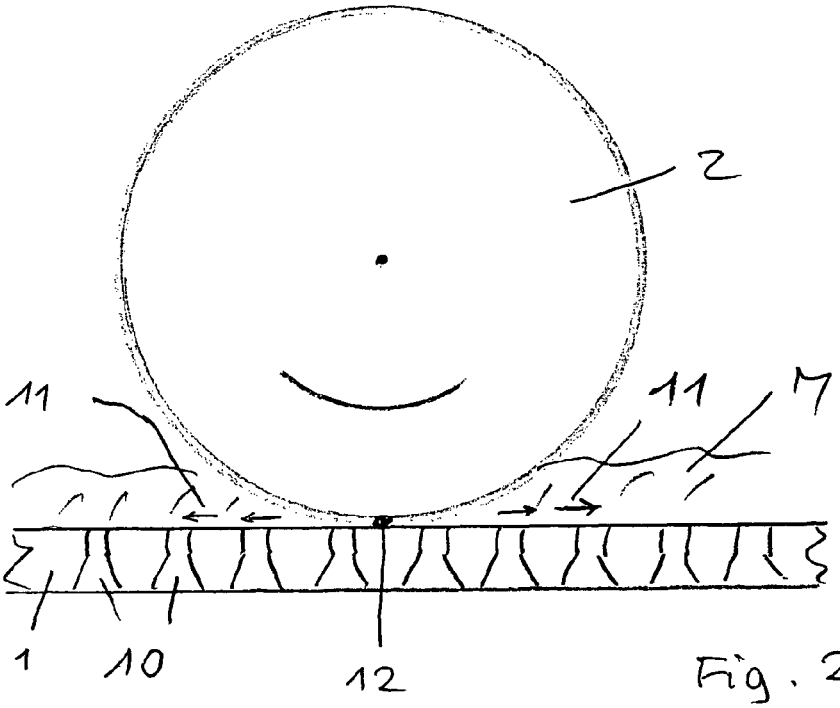
FIG. 2 shows a plan view in the direction of the cylindrical axis of the pan grinder roller of the pellet press in FIG. 1.

FIG. 2 shows the drilled holes 10 in the die 1 wherethrough the material 7 is forced. The press seam 12 identifies the location where the pan grinder roller 2 touches die 1 or comes closest thereto. Here the material escapes outwardly away from the press seam 12 in the direction of arrows 11 in so far as it is not forced through the drilled holes 10, which is effectuated by the intensive shearing stress applied to the material.

Example 1

The feed material for the disintegration process was produced by mixing 60% by weight of wood chopping chips of spruce wood having a saturation water content of w=58% and 40% by weight of lignite having a particle size of 0-20 mm and a saturation water content of w=54%. The raw material mixture was further moistened with water in the course of mixing in an Eirich mixer sufficient to achieve the strongly surface moist state of the mixed material at w=62%. Disintegration of the mixed material was achieved using a flat die pellet press equipped with a flat die having 4 mm round holes and a thickness of 20 mm. The round holes in the die have an equidistant separation from each other of 4 mm. The hole channel has a cylinder length of 5 mm in its upper part. Thereafter, the channel widens to a diameter of 6 mm. The round holes are not milled in from the upper side. The pressure in the hydraulic system is up to 200 bar. The disintegration process in the flat die pellet press gives rise to a fiber which is discharged through the holes in the flat die as an interadhered mass without pellet formation. The disintegrated material is pre-dried to the surface moist state at water contents of about $w \approx 45$ to 50% and thereafter dispersed with a bladed disk mill having a 4 mm discharge sieve of Conidur metal to form a loose fiber of waddinglike texture. Following the residual drying of the fiber to a water content of w=10%, the fiber obtained is a fine fiber, the fibers of which consist of an irreversible composite of wood and lignite. The novel wood-carbon fibers are notable for very good compression and binding characteristics and also for high resistance to micro- and macroorganisms. The fibers are hydrophobic, in contrast to purely wood fibers. The wood-carbon fiber floats on water for at least 4 months, unlike refiner fiber. The processing into fiber base materials produces firm and water resistant end products.

Example 2

75% by weight of wood shavings having shaving lengths of 5 to 20 mm and a saturation water content of w=54% was mixed with 25% by weight of cement (dry) after moistening thereof to form mortar using an Eirich mixer with simultaneous addition of water sufficient to set the surface moist state of the mixed material at w=61%. Disintegration of the mixed material was accomplished using a flat die pellet press under the conditions mentioned in example 1. 7 days' storage of the moist fiber to allow the cement to set in the fiber. Loosening of the interadhered fiber was accomplished using a bladed disk mill with 4 mm Conidur discharge sieve and residual drying of the fiber to w=20% for the production of resinated fiber base materials.

Example 3

70% by weight of wood chopping chips having a saturation water content of w=57% was mixed with 30% by weight of chaffed and moistened rapeseed straw having a saturation water content of w=68%. Rapeseed straw is itself a lignocellulose, but here also acts as a fiber improver. Disintegration of the mixed material was accomplished using a flat die pellet press under the conditions as in example 1. Loosening of the lightly interadhered fiber was accomplished using a mechanical vortex mixer. Resinating the moist fiber was resonated with just 4% by weight of urea-formaldehyde glue by moist hot press processes at molding temperatures of 180 to 200° C. to provide particularly firm engineering materials since the fiber has acquired a high selfbinding capacity owing to the modifying effect of the rapeseed straw.

Example 4

Chaffed maize (corn) plants of mixed ripeness having a water content of w=59% and a low proportion of rock salt (dry) in dissolved form were mixed. At the same time, water was admixed to adjust the mixed material to the surface moist state at w=68%. Disintegration was accomplished using a flat die pellet press equipped with a die having 15 mm round holes produces a fiber which is quicker to silage throughout and which, owing to the intensive disintegration of the coarse maize stalks, has a higher digestion value.

Example 5

98% by weight of wood chopping chips having a water content of w=45% and 2% by weight of slaked lime (dry) previously dissolved and dispersed in water were mixed. Additional moistening adjusts to the surface moist state of w=61%. The slaked lime solution has an alkaline effect which amplifies the disintegration of wood to a fiber. Moreover, the calcium ions react with wood ingredients during disintegration. Disintegration of the slaked lime containing wood chopping chips using the flat die pellet press equipped with a die having 6 mm round holes provides a fiber that is quick to dry. The drying time is shortened by 40% compared with wood shavings of similar shaving length. The fiber is also notable for very good pelleting characteristics and the pellets obtained therefrom burn with particularly low emissions since the pellets have a comparatively high fire destructurization temperature and the slaked lime becomes effective as an additive.

Example 6

40% by weight of chaffed wheat straw having a water content of w=18% and 60% by weight of detubered sugar beet leaves having a water content of w=76% were mixed. Disintegrating the mixed material was accomplished using a flat die pellet press under the processing conditions mentioned in example 1 to provide a surface moist defiberized disintegrated material being obtained under the sustainedly applied rolling pressure stress. The pasty mass, which consists of the sugar beet leaves, penetrates the straw fibers and is fully absorbed by these without separation of liquid. The result is a straw-sugar beet leaf fiber which dries rapidly and without developing water content spans and has good pelleting properties. The pellets are a high value and storable feed.

The invention claimed is:

1. A method for the disintegration of lignocellulosic materials to fibers for producing engineering materials, insulating materials, reinforcing materials or filler materials, comprising:

providing lignocellulosic materials in a surface moist state in which the water content of the lignocellulosic material is approximately five to fifteen percent higher than saturation water content;

mixing said lignocellulosic material with fiber improvers;

delivering said lignocellulosic material and fiber improvers to a flat die pellet press;

subjecting said lignocellulosic material and fiber improvers to an adjustable rolling pressure in said flat die pellet press causing said fiber improvers, augmented by the high moisture in a pore interior of the lignocellulosic material to penetrate far into the interior of and react with the lignocellulosic material resulting in an enhanced material; and forcing said enhanced material through a plurality of holes in a die of the flat die pellet press.

2. The method according to claim 1, wherein said adjustable rolling pressure is specifically adjustable with respect to intensity and duration.

3. The method according to claim 1, wherein said flat die press comprises one or more pan grinder rollers and a die and the pan grinder rollers and/or the die of the flat die press are subjected to adjustable spring force.

4. The method according to claim 1, wherein said flat die press comprises one or more pan grinder rollers and a die and the pan grinder rollers and/or the die of the flat die press are subjected to adjustable hydraulic pressure.

5. The method according to claim 1, comprising before said step of delivering:

pre-comminution of the lignocellulosic material to a particle size of ≤200 mm and preferably ≤50 mm; and moistening of the lignocellulosic material sufficient to achieve the saturation water content specific to the particular lignocellulosic material.

6. The method according to claim 1, wherein said flat die press includes driven pan grinder rollers to apply the adjustable rolling pressure to the lignocellulosic material.

7. The method according to claim 1, comprising discharging said enhanced material through the plurality of holes in the die and also through an edge weir.

8. The method according to claim 1, comprising selecting said one or more fiber improvers from the following group for mixing with said lignocellulosic material:

a. 5% to 60% by weight of lignite having deposit dependent saturation water contents of 50 to 60%;
b. 10% to 40% by weight of cement (dry) after moistening to form mortar;
c. 1% to 40% by weight of slaked lime (dry) after moistening to form mortar;
d. 5% to 40% by weight of gypsum (dry) after moistening to form mortar;
e. 5% to 50% by weight of power station filter ashes (dry) after wet disintegration grinding to form a mortar mass;
f. 5% to 60% by weight of lean quark or quark rich enhancement products;
g. 5% to 25% by weight of protein rich extraction grains from oilseeds (dry) after wet disintegration grinding to form a finely disperse mass and/or through cooking of a pasty mass;
h. 3% to 15% by weight of starch or starch rich raw materials (dry) after disintegration into pasty glues or after thin cooking;
i. 1% to 15% by weight of sugar or sugar rich raw materials after dissolution;
j. 1% to 15% by weight of natural or synthetic glues;
k. 0.5% to 10% by weight of paraffins and/or asphalts, pitches, waxes, resins after liquefaction thereof;
l. finely granular or liquid nutrient materials, mineral salts and/or vitamins of the type and amount required in the use scenario;
m. salt for producing fibers for silages;
n. 1% to 20% by weight of acids and/or salts having a preservative action;
o. fertilizers of the type and proportion needed by the field of use; and
p. clay and loam minerals in the proportions depending on the use scenario.

9. The method according to claim 1, comprising treating the lignocellulosic material after exposure to fiber improvers in a surface moist state and discharge from the flat die pellet press through storage, drying, or loosening comminution, or a combination thereof to form a sheet of loose fiber.

10. The method according to claim 9, wherein the loosening comminution of the lignocellulosic material to form the sheet of loose fiber after a pre-drying to moisture contents of $w \leq 50\%$ utilizes mechanical vortex mixers, disk mills, pin mills, bladed disk mills, impact plate mills or beater mills having one or two rotors.

11. The method according to claim 9, wherein the drying and loosening of the lignocellulosic material are carried out simultaneously with dryers equipped with mechanical loosening devices.

12. The method according to claim 9, in that the lignocellulosic material is pressed into pellets, strands, or plaques.

* * * * *